US006957643B2

(12) United States Patent
Lee et al.

(10) Patent No.: US 6,957,643 B2
(45) Date of Patent: Oct. 25, 2005

(54) INTEGRATED CARRIER FOR VEHICLE INTAKE MANIFOLD

(75) Inventors: Ki-Ho Lee, Windsor (CA); James Kenneth Vanderveen, Blenheim (CA)

(73) Assignee: Siemens VDO Automotive Inc., Chatham, CA (US)

( * ) Notice: Subject to any disclaimer, the term of this patent is extended or adjusted under 35 U.S.C. 154(b) by 0 days.

(21) Appl. No.: 10/851,578

(22) Filed: May 21, 2004

(65) Prior Publication Data

US 2004/0261770 A1 Dec. 30, 2004

Related U.S. Application Data

(60) Provisional application No. 60/472,860, filed on May 23, 2003.

(51) Int. Cl.[7] ..... F02M 39/00
(52) U.S. Cl. ..... 123/470; 123/456; 123/469
(58) Field of Search ..... 123/456, 468, 123/469, 470

(56) References Cited

U.S. PATENT DOCUMENTS 4,563,984 A * 1/1986 Ziegler et al. ..... 123/184.61
4,570,601 A * 2/1986 Ito et al. ..... 123/468
4,966,120 A * 10/1990 Itoh et al. ..... 123/516
5,111,794 A * 5/1992 DeGrace, Jr. ..... 123/470
5,127,382 A * 7/1992 Imoehl ..... 123/470
5,168,857 A * 12/1992 Hickey ..... 123/468
5,598,824 A * 2/1997 Treusch et al. ..... 123/470
5,718,206 A * 2/1998 Sawada et al. ..... 123/470
6,308,686 B1 * 10/2001 Mammarella et al. ..... 123/470
6,502,552 B2 1/2003 Lee ..... 123/456
6,622,700 B2 9/2003 Lee et al. ..... 123/456
6,666,190 B1 * 12/2003 DiMaria et al. ..... 123/470
6,769,410 B2 8/2004 Lee et al. ..... 123/470
2002/0190480 A1 * 12/2002 Gregoire ..... 277/602

* cited by examiner

*Primary Examiner*—Weilun Lo
(74) *Attorney, Agent, or Firm*—Pasquale Musacchio

(57) ABSTRACT

A carrier for mounting to an internal combustion engine having an intake manifold port, a fuel injector and a cylinder head port extending from a cylinder head. The carrier includes a central portion having an internal passageway for providing fuel to the fuel injector. An attachment portion extends from the central portion which is affixed between the cylinder head and the intake manifold ports. The carrier further includes a sleeve extending from the central portion for receiving the fuel injector, which is sealed by the sleeve and an O-ring. The fuel injector, port seals, injector O-ring, wiring harness, connector and fuel rail are integrated into a single carrier to provide sealing, electrical connectivity, and fuel delivery functions.

20 Claims, 2 Drawing Sheets

INTEGRATED CARRIER FOR VEHICLE INTAKE MANIFOLD

PRIORITY CLAIM

This application claims the benefit of U.S. Provisional Application No. 60/472,860 filed on May 23, 2003 in the name of Ki-Ho Lee and James Kenneth Vanderveen and entitled INTEGRATED GASKET CARRIER which is hereby incorporated by reference herein in its entirety.

BACKGROUND OF THE INVENTION

This invention relates to a fuel injection system for an internal combustion engine, and more particularly, to an integrated carrier having a fuel injector assembly, fuel rail, wiring harness and connector which may be assembled to a motor vehicle intake manifold.

An air intake manifold distributes air to cylinders of an internal combustion engine. The manifold is typically mounted to a cylinder head of the engine. The manifold is in close proximity to various electrical components of the engine such as fuel injectors, electric throttle body, throttle position sensors and air and temperature sensors.

A conventional fuel injection system includes a plurality of fuel injectors mounted to an intake manifold. Fuel is supplied to each fuel injector through a fuel rail. Each fuel injector is selectively actuated to meter a desired amount of fuel into a combustion chamber. Electric signals for controlling the fuel injectors are typically communicated through a conventional wire harness. Such harnesses include a main connector that is attached to a controller and a plurality of wires that are routed to individual fuel injectors. Conventional wire harnesses are expensive to manufacture and assemble onto the vehicle engine. In addition, wire harnesses are bulky and subject to damage due to the hostile environment that exists within the vehicle engine compartment.

Conventional fuel injection systems include many components that must be assembled, which increases the likelihood of fuel permeating or leaking from the system. The fuel injectors may include an O-ring or other seal at opposing ends that are received in the fuel rail and intake manifold. For a six-cylinder engine, up to twelve seals may be needed solely for the fuel injectors.

Currently, there are very strict rules limiting the amount of hydrocarbons that may leak or permeate from a vehicle. Each connection between components presents a potential for leaking or permeation of fuel vapor. Furthermore, fuel injection systems are under relatively high pressures. As a result, there is an increased opportunity for fuel to leak or permeate past the seals. Accordingly, it is desirable to provide an integrated assembly that reduces the number of connections that must be sealed and that incorporates several different functions such as sealing, electrical connectivity, and fuel delivery to provide for improved sealing and wiring protection along with decreased cost and assembly time.

SUMMARY OF THE INVENTION

A carrier for mounting to an internal combustion engine having an intake manifold port, a fuel injector and a cylinder head port extending from a cylinder head is disclosed. The carrier includes a central portion having an internal passageway for providing fuel to the fuel injector. An attachment portion extends from the central portion which is affixed between the cylinder head and the intake manifold ports. The carrier further includes a sleeve extending from the central portion for receiving the fuel injector, wherein the fuel injector is removably affixed to the cylinder head. In accordance with the present invention, the fuel injector, port seals, injector O-ring, wiring harness, connector and fuel rail are integrated into a single carrier to provide sealing, electrical connectivity, and fuel delivery functions.

These and other features of the present invention can be best understood from the following specification and drawings, the following of which is a brief description.

DETAILED DESCRIPTION OF THE INVENTION

Figure 1:
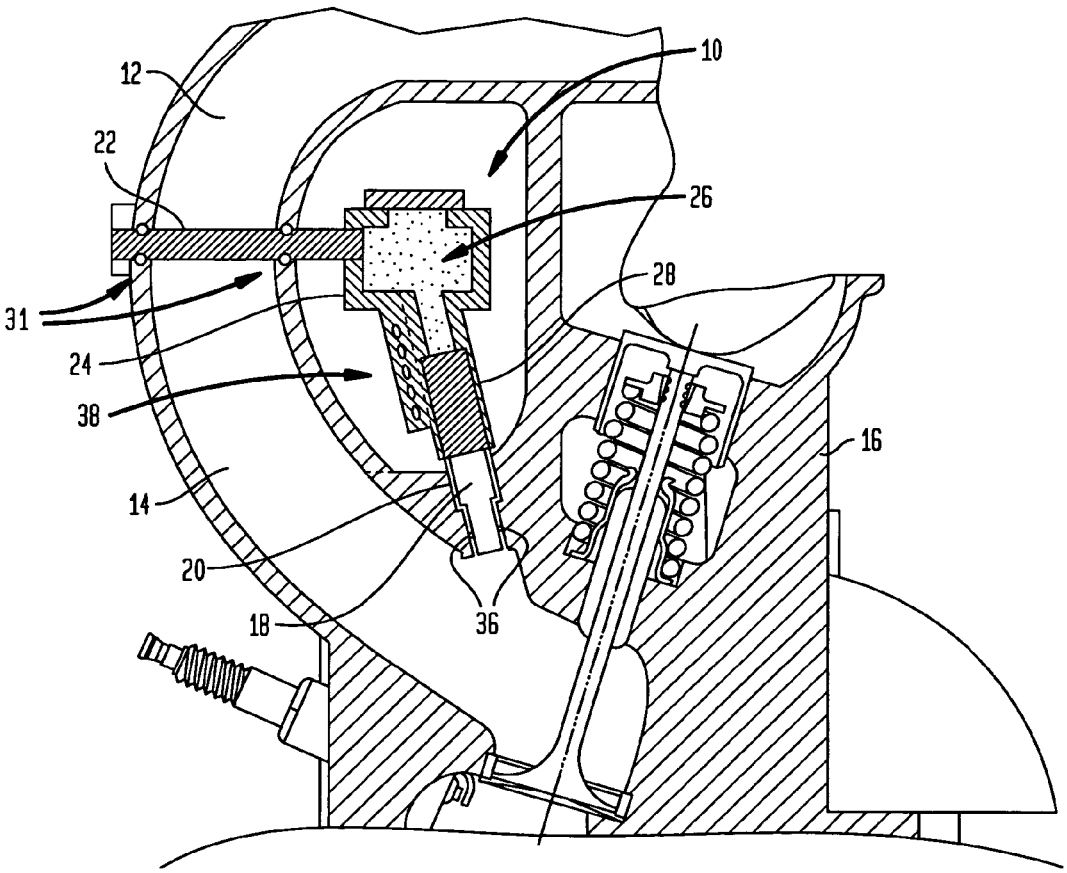
FIG. 1 depicts an integrated carrier of the present invention as a partial cross sectional view.

While this invention is susceptible of embodiment in many different forms, there is shown in the drawings and will herein be described in detail specific embodiments, with the understanding that the present disclosure is to be considered as an example of the principles of the invention and not intended to limit the invention to the specific embodiments shown and described. In the description below, like reference numerals are used to describe the same, similar or corresponding parts in the several views of FIGS. 1–2B.

Figure 2A:
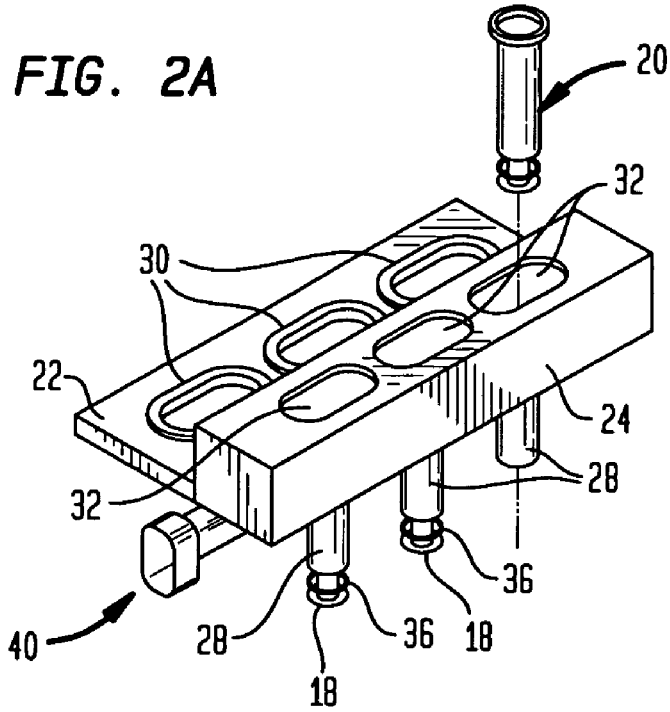
FIG. 2A depicts a perspective view of the carrier and shows a top opening for providing access to a sleeve for inserting a fuel injector valve body.
Figure 2B:
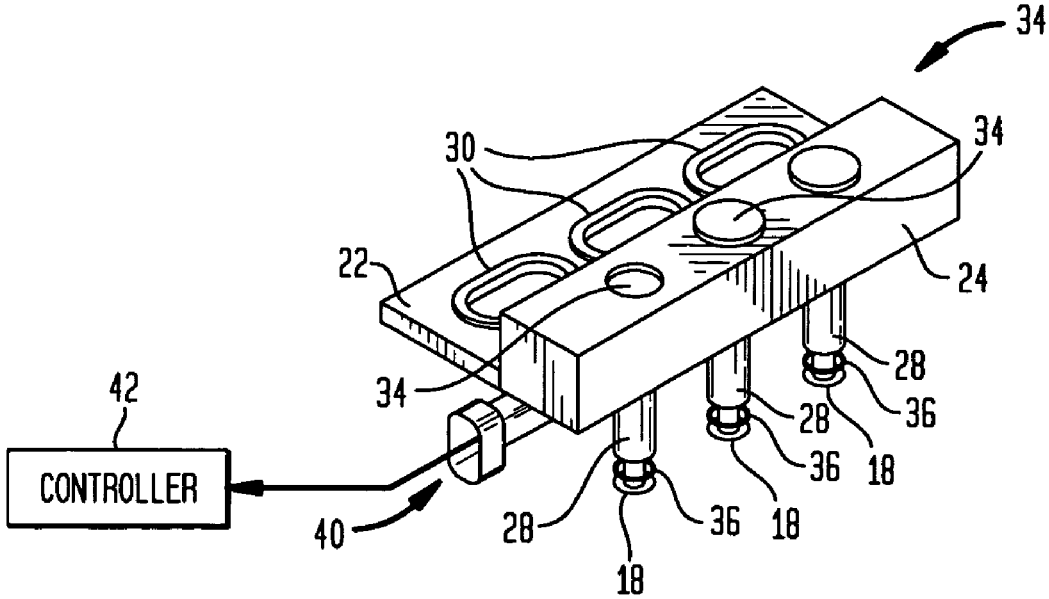
FIG. 2B depicts an assembled carrier wherein the fuel injector is inserted into the sleeve and the opening is closed by a cap.

The present invention as described herein and shown in FIGS. 1–2B is directed to an integrated gasket or carrier 10 for use in an internal combustion engine, such as a multi-port fuel injected engine. For example, the carrier 10 may be used with engines having cylinder head and manifold configurations such as those manufactured by the Ford Motor Co. and other manufacturers. Referring to FIG. 1, such engines may include at least one intake manifold port 12, a cylinder head port 14 extending from an engine cylinder head 16 and a fuel injector 18 having a valve body 20. It is noted that the carrier 10 extends to additional cylinder head ports and corresponding intake manifold ports and fuel injectors for a multi-port engine.

In FIG. 1, the carrier 10 is shown as a partial cross sectional view. The carrier 10 may be fabricated from a polymer or other suitable material. The carrier 10 includes a laterally extending attachment portion 22 which is removably affixed between the cylinder head port 14 and the intake manifold port 12. In one embodiment, the attachment portion 22 is approximately 7 mm thick. The attachment portion 22 extends from a central portion 24 having an internal channel 26. The channel 26 is in fluid communication with the fuel injector 18 and serves as a fuel rail for providing fuel to the fuel injector 18, which may be a DEKA VII™ fuel injector such as that manufactured by Siemens VDO Automotive Corp. In one embodiment, the channel 26 has a substantially rectangular shape optimized to provide fuel dampening. A sleeve 28 having a through hole for receiving the valve body 20 extends downwardly to the cylinder head 16 from the central portion 24. It is noted that each fuel injector has a corresponding sleeve. The carrier 10 may be located in the space formed between the cylinder head 14 and intake manifold 12 port runners and the cylinder head 16.

Referring to FIGS. 2A and 2B, a perspective view of the carrier 10 is shown in a configuration adapted for a 3 cylinder engine, although it is understood that the carrier 10 may be adapted for other engine configurations such as a V-6, inline 4 cylinder and others. The carrier 10 includes grooves 30 configured for receiving the cylinder head 14 and intake manifold 12 port runners to thus form port seals 31. Referring to FIG. 2A in conjunction with FIG. 1, the central portion 24 includes corresponding openings 32 for providing access to each sleeve 28, thus enabling insertion of each valve body 20 through corresponding openings 32 and into a corresponding sleeve 28. In one embodiment, each valve body 20 is force fit into each corresponding sleeve 28. Each valve body 20 may then be welded to each corresponding sleeve 28 by laser, hot plate, ultrasonic or vibration welding techniques or other attachment method so as to provide a hermetic seal. In FIG. 2A, two valve bodies are shown inserted into corresponding sleeves. Referring to FIGS. 1 and 2B, upon assembly of each fuel injector 18, each opening 32 is then closed by a cap 34 which may be affixed to the central portion 24 by laser, hot plate, ultrasonic or vibration welding techniques or other attachment method such as by using an adhesive, epoxy, or a seal and fasteners. In accordance with the present invention, each fuel injector 18 is removably affixed to the cylinder head 16. An O-ring 36 is located on a bottom portion of each fuel injector 18 to form a seal between each valve body 20 and corresponding cylinder head port 14.

Referring to FIGS. 2A and 2B in conjunction with FIG. 1, the central portion 24 further includes a plurality of leadframes 38 which electrically connect each fuel injector 18 to a connector 40 such as a four way connector. The connector 40 is then attached to a controller 42 for controlling each fuel injector 18. The leadframes 38 are embedded within the central portion 24, thus providing protection from the hostile environment within a vehicle engine compartment. Alternatively, a conventional wire harness may be attached to the carrier 10 to electrically connect each fuel injector 18 to the controller 42.

In accordance with the present invention, each fuel injector 18, port seals, injector O-ring 36, leadframes 38, connector 40 and channel 26 are integrated into a single carrier to provide a gasket having sealing, electrical connectivity, and fuel delivery functions to improve sealing and wiring protection along with decreasing costs and assembly time. The disclosures of U.S. Pat. Nos. 6,502,552 and 6,622,700 and that of U.S. Pat. No. 6,769,410 filed May 13, 2003, are hereby incorporated by reference in their entirety to provide further disclosure regarding fabrication of the carrier, fuel injector and wiring harness and other related items.

While the invention has been described in conjunction with specific embodiments, it is evident that many alternatives, modifications, permutations and variations will become apparent to those skilled in the art in light of the foregoing description. Accordingly, it is intended that the present invention embrace all such alternatives, modifications and variations as fall within the scope of the appended claims.

What is claimed is:

1. A carrier for mounting to an internal combustion engine having an intake manifold port, a fuel injector and a cylinder head port extending from a cylinder head, comprising:

a central portion having an internal passageway for providing fuel to said fuel injector;

an attachment portion extending from said central portion for affixing between said cylinder head and intake manifold ports; and a sleeve extending from said central portion for receiving said fuel injector, wherein said sleeve extends toward said cylinder head to enable said injector to be attached to said cylinder head.

2. The carrier according to claim 1, wherein said attachment portion includes grooves for providing a seal with said cylinder head and intake manifold ports.

3. The carrier according to claim 1, wherein said internal passageway has a substantially rectangular shape.

4. The carrier according to claim 1, wherein said fuel injector is removably affixed to said cylinder head and is sealed by said sleeve and an O-ring.

5. The carrier according to claim 1, wherein a body of said fuel injector is force fit into said sleeve.

6. The carrier according to claim 1 wherein said attachment portion is approximately 7 mm thick.

7. The carrier according to claim 1 further including leadframes and a connector for electrically connecting said fuel injector to a controller.

8. The carrier according to claim 1, wherein said carrier is fabricated from a polymer.

9. A gasket carrier for mounting to an internal combustion engine having an intake manifold port, a fuel injector and a cylinder head port extending from a cylinder head, comprising:

a central portion having an internal passageway for providing fuel to said fuel injector;

an attachment portion extending from said central portion for affixing between said cylinder head and intake manifold ports;

a sleeve extending from said central portion for receiving said fuel injector, wherein said central portion includes an opening for providing access to said sleeve and wherein said sleeve extends toward said cylinder head to enable said injector to be attached to said cylinder head; and leadframes and a connector for electrically connecting said fuel injector to a controller.

10. The carrier according to claim 9, wherein said attachment portion includes grooves for providing a seal with said cylinder head and intake manifold ports.

11. The carrier according to claim 9, wherein said internal passageway has a substantially rectangular shape.

12. The carrier according to claim 9, wherein said fuel injector is removably affixed to said cylinder head and is sealed by said sleeve and an O-ring.

13. The carrier according to claim 9, wherein a body of said fuel injector is force fit into said sleeve.

14. The carrier according to claim 9 wherein said attachment portion is approximately 7 mm thick.

15. The carrier according to claim 9, wherein said carrier is fabricated from a polymer.

16. A gasket carrier for mounting to an internal combustion engine having an intake manifold port, a fuel injector and a cylinder head port extending from a cylinder head, comprising:

a central portion having an internal passageway for providing fuel to said fuel injector;

an attachment portion extending from said central portion for affixing between said cylinder head and intake manifold ports;

a sleeve extending from said central portion for receiving said fuel injector, wherein said central portion includes an opening for providing access to said sleeve wherein said fuel injector is sealed by said sleeve and an O-ring and wherein said sleeve extends toward said cylinder head to enable said injector to be attached to said cylinder head; and leadframes and a connector for electrically connecting said fuel injector to a controller.

17. The carrier according to claim 16, wherein said attachment portion includes grooves for providing a seal with said cylinder head and intake manifold ports.

18. The carrier according to claim 16, wherein said central and attachment portions and said sleeve are located between said cylinder head and said cylinder head and intake manifold ports.

19. The carrier according to claim 16, wherein a body of said fuel injector is force fit into said sleeve.

20. The carrier according to claim 16, wherein said carrier is fabricated from a polymer.

* * * * *